US006567047B2

(12) United States Patent
Kuck

(10) Patent No.: US 6,567,047 B2
(45) Date of Patent: May 20, 2003

(54) MULTI-BAND IN-SERIES ANTENNA ASSEMBLY

(75) Inventor: Richard T. Kuck, San Jose, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/865,092

(22) Filed: May 24, 2001

(65) Prior Publication Data

US 2002/0021249 A1 Feb. 21, 2002

Related U.S. Application Data

(60) Provisional application No. 60/206,899, filed on May 25, 2000.

(51) Int. Cl.[7] ..... H01Q 1/38; H01Q 1/24

(52) U.S. Cl. ..... 343/700 MS; 343/702

(58) Field of Search ..... 343/700 MS, 702, 343/846, 848; 455/89, 90

(56) References Cited

U.S. PATENT DOCUMENTS

| | | | | |
|---|---|---|---|---|
| 5,734,350 A | * | 3/1998 | Deming et al. | 343/700 MS |
| 6,008,762 A | * | 12/1999 | Nghiem | 343/700 MS |
| 6,208,298 B1 | * | 3/2001 | Uchino et al. | 343/700 MS |
| 6,218,991 B1 | * | 4/2001 | Sanad | 343/700 MS |

* cited by examiner

*Primary Examiner*—Tan Ho
(74) *Attorney, Agent, or Firm*—Fulbright & Jaworski L.L.P.

(57) ABSTRACT

A multi-band in-series antenna assembly comprising a resonator and a ground plane of a wireless communication device. The resonator element includes first and second conductive portions which are electrically connected in series to each other by a conducting element. The conductive portions and the conducting element are provided upon a dielectric substrate which is oriented in a superposed and divergent relation relative to the ground plane of a wireless communication device. The first and second conductive portions include inwardly facing edges and outwardly facing edges (relative to the wireless communication device) which define the shapes of the first and second conductive portions, respectively. The first conductive portion also includes a ground attachment point, a feed attachment point and a conducting element attachment point which may be operatively connected to a ground plane, a radio frequency input/output port, and the conducting element, respectively. Similarly, the second conductive portion also includes a conducting element attachment point which may be operatively connected to the conducting element. The first and second conductive portions are differently shaped and sized to enable them to operate at different frequencies. Preferably, the first and second conductive portions and the conducting element are positioned on opposing surfaces of the dielectric substrate by conventional technologies and techniques.

13 Claims, 4 Drawing Sheets

MULTI-BAND IN-SERIES ANTENNA ASSEMBLY

This application claims the benefit of U.S. Provisional Application No. 60/206,899 filed May 25, 2000 entitled, "Dual Band In-Series Antenna Assembly," incorporated by reference herein.

FIELD OF THE INVENTION

The present invention relates to an antenna assembly suitable for wireless transmission of analog and/or digital data, and more particularly to an antenna assembly featuring a multi-band in series low specific absorption rate (SAR) antenna for use with wireless communication devices.

BACKGROUND OF THE INVENTION

Existing antenna structures for wireless devices include both external and internal structures. External single or multi-band wire dipole antennas are half wave antennas operating over one or more frequency ranges. These antennas have minimal front to back ratio and therefore radiate generally equally toward and away from the user of the wireless device without specific absorption rate (SAR) reduction. LC (inductor and capacitor) traps may be used to achieve multi-band resonances.

Another external antenna structure is a single or multi-band asymmetric wire dipole. This antenna is a quarter wave resonator operating over one or more frequency ranges. An additional quarter wave conductor is utilized to achieve resonance. The typical gain is +2 dBi. There is minimal front to back ratio or SAR reduction. LC traps may be used to achieve multi-band resonances. The beamwidth near the head is limited to 80 degrees nominal.

Internal single or multi-band antennas include asymmetric dipole antennas. These antennas include quarter wave resonant conductor traces, which may be located on a planar, printed circuit board. These antennas operate over one or more frequency ranges with a typical gain of +1 to +2 dBi, and have a slight front to back ratio and reduced SAR. These antenna structures may have one or more feedpoints, and require a second conductor for a second band resonance.

Another internal antenna structure is a single or multi-band Planar Inverted F Antenna ("PIFA"). These are planar conductors that may be formed by metallized surfaces covering a resin-based member (commonly referred to as a "plastic"-based member). PIFA operate over a second conductor or a ground plane. The typical gain for such antennas is +1.5 dBi. The front to back ratio and SAR values are dependent on frequency.

There exists a need for an antenna assembly which is compact, lightweight and which may be incorporated into a variety of wireless communication devices.

SUMMARY OF THE INVENTION

A dual band in-series antenna assembly is provided. The antenna assembly comprises a resonator and a ground plane of a wireless communication device. The resonator element includes first and second conductive portions which are operatively coupled to each other by a conducting element. The conductive portions of the resonator may be carried by a dielectric substrate which is oriented in a superposed and divergent relation relative to the ground plane of a wireless communication device. This creates an open space into which various componentry may be positioned to facilitate compact construction. The first conductive portion also includes at least one discrete ground attachment location (i.e., an electrical connection to a conductor having reduced electrical potential), a feed attachment point and a conducting element attachment point which may be operatively connected to a ground plane, a radio frequency input/output port, and the conducting element, respectively. Similarly, the second conductive portion includes an inwardly facing edge and an outwardly facing edge, relative to the wireless communication device. And, as with the first conductive portion, the inwardly facing and outwardly facing edges define the shape of the second conductive portion. The second conductive portion also includes a conducting element attachment point which may be operatively connected to the conducting element. The first conductive portion and the second conductive portions may be differently shaped and sized to enable them to operate at different frequencies. Preferably, the first conductive portion is larger than the second conductive portion.

In one preferred embodiment, the first conductive portion and the second conductive portion are formed on a major surface of the dielectric substrate by conventional technologies and techniques such as electroless plating, etching, metallic deposition, photo resist, and the like. The conducting element, on the other hand, is located on the side opposite the major surface and comprises a wire, preferably 22 gauge copper, attached at conductive through-holes in the dielectric substrate in a conventional manner. The resonator is operatively connected to the ground plane of a wireless communication device through the first conductive portion and an appropriate conductor.

In a second embodiment, the single connection between the resonator and the ground plane is replaced with a pair of circuit connectors, one for each conductive portion of the resonator. Preferably, the circuit connectors are in the form of tunable inductive capacitive (LC) traps.

In operation, the resonator element works in concert with a ground plane of a wireless communication device, where the ground plane can be formed as a part of a printed wiring board.

To optimize performance, the resonator element is positioned in a predetermined area which is less likely to be overlaid by a hand of a user; in this instance adjacent the top of a wireless communication device.

It is an object of the present invention to provide a dual band, or if desired, a tri-band antenna assembly which may be incorporated into a wireless communication device in a compact and lightweight unit, in part by utilizing in-series electrical connection between a low frequency-sensitive and a high frequency-sensitive portion of the antenna. Such an in-series electrical connection allows use of a reduced amount of conductive material with typical, prior art dual band antennas because such prior art units typically require relatively larger conductive areas for the low and high frequency sensitive regions due to their in-parallel configuration. Thus, the multi-band antenna(s) configured in conformity with the teaching of the present invention can be made smaller, more compact, and lighter in weight than such prior art multiple band antennas.

A feature of the present invention is that the in operation the inventive antenna utilizes a single discrete location, or "feed point," for multiple bands of electromagnetic frequencies.

Another feature of the present invention is that fabrication may be accomplished through existing technologies and cost effective mass production techniques as are commonly known and used in the art of printed circuit board production, among others.

An advantage of the present invention is that the antenna assembly has a low profile which enables it to be used in small articles such as wireless communication devices. In fact, the low profile of exemplary embodiments of the present invention rise a nominal 8 mm from the surface defined by the ground plane.

Other important advantages of antennas taught, enabled, described, illustrated herein include: lower specific absorption rate (SAR) function relative to prior art antenna structures; improved dipole gain; improved component match without additional matching network components; resonators electrically coupled in-series; reduction in resonator dimensions; high impedance, low frequency band resonator; low impedance high frequency band resonator; and, alternative feed options, including coaxial cable, micro-strip feed, and the like. Furthermore, the size and shape of the dielectric substrate upon which the antenna assembly resides may be tailored to fit within very compact electronic devices, including completely within the device housing without protruding or extending to the exterior thereof.

Another advantage of the present invention is that various components of a transceiver device may be positioned within interior regions of the antenna assembly to reduce the overall size of the electronic device thereby encouraging more compact wireless communication devices while maintaining desirable operating characteristics of larger prior art antenna designs.

These and other objects, features and advantages will become apparent in light of the following detailed description of the preferred embodiments in connection with the drawings.

DETAILED DESCRIPTION OF THE PREFERRED EMBODIMENTS

Figure 1:
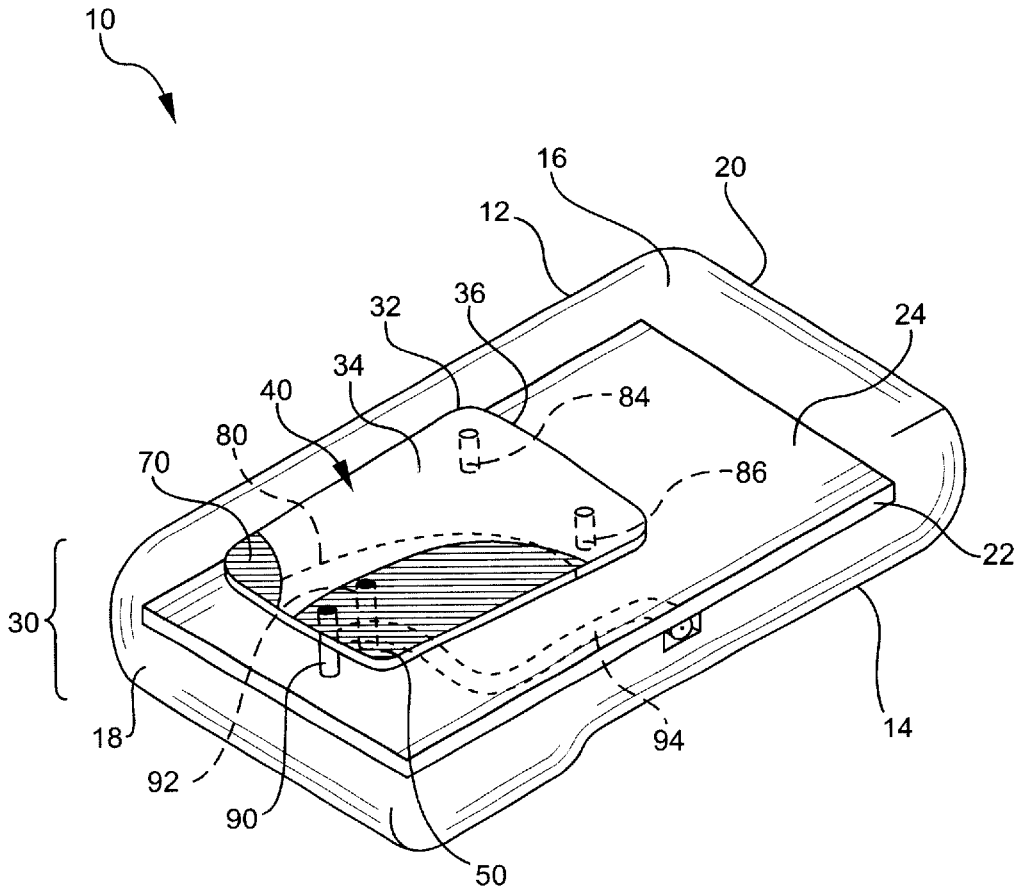
FIG. 1 is a partial, perspective view of a wireless communication device incorporating an antenna assembly according to the present invention.

Referring now to the drawings, wherein like numerals depict like parts throughout, FIG. 1 illustrates a wireless communication device (WCD) 10 having a housing 12 with a front 14, a rear or back 16, a top 18, a bottom 20 and a printed wiring board (PWB) 22. Portions of the wireless communication device 10 have been omitted to illustrate the juxtaposition of the antenna assembly 30 as it resides within the housing 12. The antenna assembly 30 comprises a resonator assembly 40 and the ground plane 24 of the printed wiring board 22. As depicted, the resonator assembly 40 is superposed a predetermined distance relative to the ground plane 24 of the printed wiring board 22.

Figure 2:
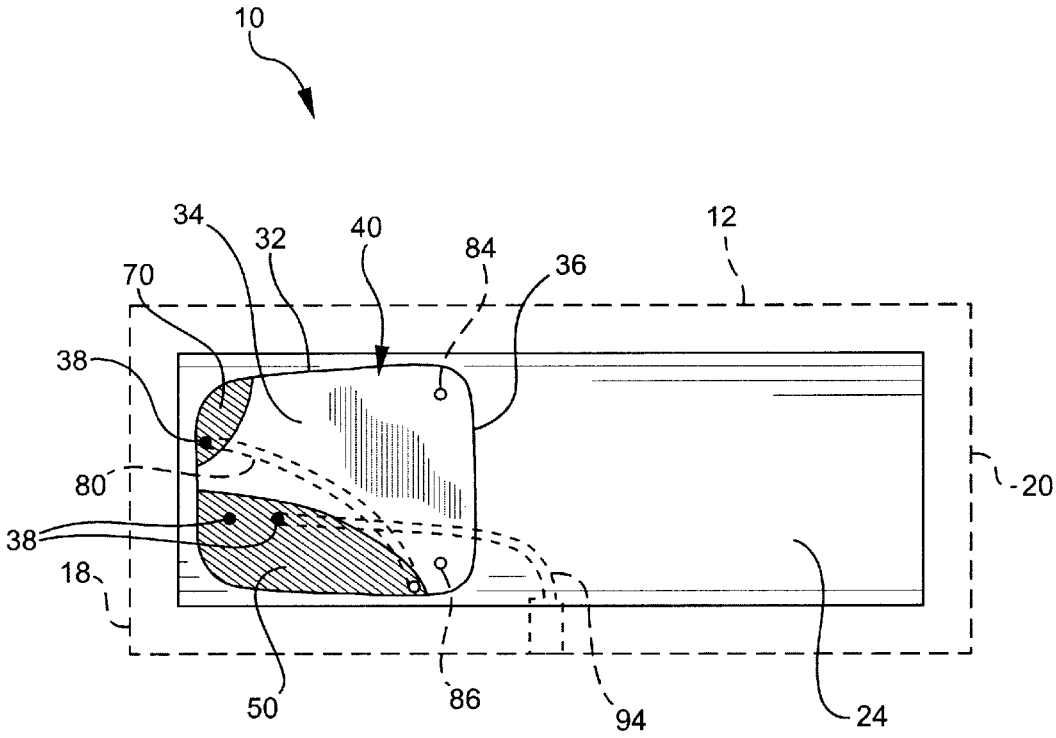
FIG. 2 is a plan view of the antenna assembly according to the present invention taken from the back of a wireless communication device, with the wireless communication device depicted in phantom.

Turning to FIG. 2, the resonator 40 comprising conductive portions 50 and 70 is carried on a major surface 34 of a dielectric substrate 32. Briefly, the dielectric substrate 32 includes a perimeter 36 and a plurality of conductive through-holes 38, with the perimeter 36 generally defined by the housing 12 of the wireless communication device 10, and with the conductive through-holes 38 permitting simplified attachment of antenna assembly components, respectively. While the dielectric substrate 32 has a perimeter 36 in the shape of a quadrilateral, it is understood that it may take other forms. For example, a square, a triangle, circle, etc. Or, portions of the dielectric substrate 32 may be removed to facilitate compact assembly, thus creating irregular shapes (not shown). The conductive through-holes 38 are located at predetermined positions on the dielectric substrate 32 depending upon the operational characteristics of the antenna assembly 30. Generally, the dielectric substrate is a printed circuit board laminate having a nominal thickness of around 1.50 mm. While the preferred dielectric substrate is formed from GETEK® (manufactured by the General Electric Company Corporation) it is understood that other laminate material having similar properties may be used.

Figure 3:
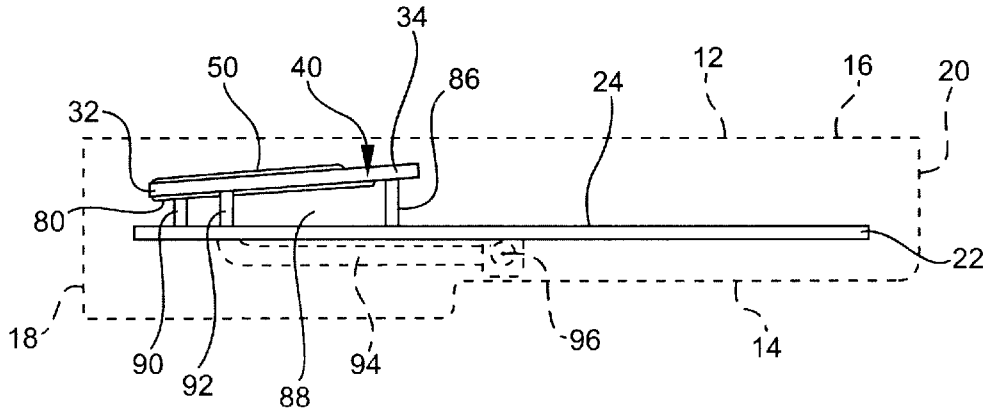
FIG. 3 is a side view of the antenna assembly of FIG. 1, with the wireless communication device depicted in phantom.

As previously mentioned, in one embodiment, the dielectric substrate 32 is oriented in a superposed and divergent relation relative to the ground plane 24 of a wireless communication device 10. As shown in FIG. 3 and with reference to the top and bottom ends 18, 20 of the housing 12, bottom end of the dielectric substrate 32 is spaced a predetermined distance from the ground plane 24 of the printed wiring board 22 by support elements 84 and 86. Preferably, the distance between the major surface 34 at the bottom end of the dielectric substrate 32 and the ground plane 24 is around 8.00 mm for a particular embodiment of the frequencies depicted. Moving towards the top end of the dielectric substrate 32, the dielectric substrate 32 is spaced a predetermined distance from the ground plane 24 by conductors 90, 92 to the ground plane 24 and feed line 94, respectively. Note that the distance between the major surface 34 and the ground plane 24 may be substantially parallel or may diminish until the spacing between the major surface 34 at the top end of the dielectric substrate 32 is around 5.50 mm. In the case that the spacing is not substantially parallel the operation of the antenna assembly 30 of the present invention is robust enough to perform satisfactorily. While a divergent relation is illustrated preferred, it is to be understood that the orientation of the dielectric substrate 32 and the ground plane 24 may alternatively be parallel. Note also, that the distances between the major surface 34 and the ground plane 24 may be reduced by positioning a dielectric element within the open space 88 defined by the dielectric substrate 32 and the printed wiring board 22. It will be appreciated that various support members (not shown) may be positioned between the dielectric substrate 32 and the printed wiring board 22 to increase or decrease the spacing therebetween (i.e., the volume of open space 88 between dielectric substrate 32 and the printed wiring board 22 may vary as desired). For example, in an additional embodiment of the present invention, and primarily to promote a more compact overall structure to the wireless communication device 10, a wedge member (not shown) formed of dielectric material could be inserted into all or a portion of open space 88 thereby reducing the spacing thereof.

Figure 4:
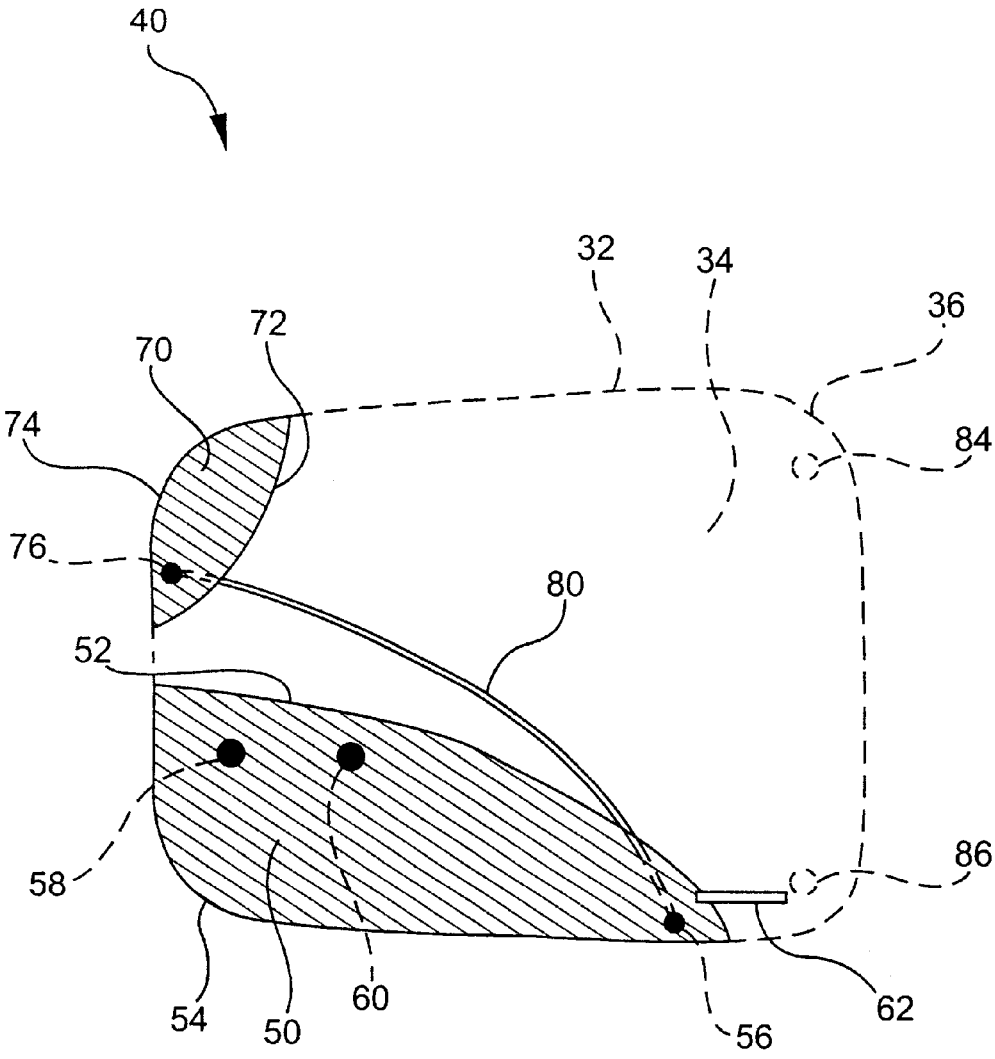
FIG. 4 is a plan view of the resonator according to the present invention taken from the back of a wireless communication device, with the dielectric substrate depicted in phantom.

With regard to FIGS. 3 and 4, the resonator 40 is shown in an elevation and plan view, respectively. As can be seen, the resonator 40 includes a first conductive portion 50 and a second conductive portion 70 operatively connected to each other by a conducting element 80. The first and second conductive portions 50, 70 are sized and shaped to provide response over different operational frequency bands. The first conductive portion 50 includes an inwardly facing or first edge 52, and an outwardly facing or second edge 54. The inwardly and outwardly facing edges 52, 54 define the shape of the first conductive portion 50. Preferably, the inwardly facing edge 52 is curved over a substantial portion of its length. The outwardly facing edge 54, on the other hand, includes two generally linear portions which are generally orthogonal to each other. The intersections of the inwardly and outwardly facing edges 52, 54 form ends with apexes. Thus, the first conductive portion 50 is operatively connected to the remainder of the antenna assembly 30 at a plurality predetermined attachment points. At attachment point 56, the first conductive portion 50 is operatively connected to the second conductive portion 70 by conducing element 80. At attachment point 58, the first conductive portion 50 is operatively connected to the ground plane by a suitable conductor 90. And, at attachment point 60, the first conductive portion 50 is operatively connected to a feed line 94 by a suitable conductor 92. Preferably, the feed line 94 is a 50 Ohm co-axial cable having an inner member 96. However, it is understood that other feed lines may be used. The co-axial cable, when used, may be provided with a suitable surface mount adaptor (not shown) to enable the wireless communication device to be fed signals from a variety of sources. Lastly, the first conductive portion 50 may include an adjustment element 62 in the form of a gimmick capacitor according to the electrical requirements of the antenna assembly 30 in view of the operating range and specification of the wireless communication device 10. Such a gimmick capacitor is a small value capacitor (e.g., under about 15 pf) and may be constructed by hand by simply manually twisting a length of single-strand resin covered hook-up wire and trimming to (and testing to confirm) a desired value. For example, a 15 cm length of hook-up wire when folded in half (crossing the ends) and twisted will, when trimmed and after stripping the ends produce such a gimmick capacitor of a desired value in a short time without undue experimentation. Of course, a mass manufactured capacitor of the desired value may be used in lieu of the gimmick capacitor just described. In another embodiment, a plurality of electrical connections to ground may be used to provide separate ground paths for electrical potential from both the first conductive portion 50 and the second conductive portion 70. Furthermore, these ground paths (or nominal ground circuits) may preferably utilize electrical components so that each may operate as individually tunable resonant ground circuitry. For example, by using a simple conductive element, the lower frequency band operates in a relatively narrow range of response. By implementing suitable tunable resonant ground circuitry for each ground path a wider band response may be obtained. Those skilled in the art will recognize many different types and forms of such tunable ground circuitry but a simple inductive capacitive (LC) trap, as more fully described with reference to FIG. 5 and FIG. 6 below.

Similarly, the second conductive portion 70 includes an inwardly facing or first edge 72, and an outwardly facing or second edge 74. The inwardly and outwardly facing edges 72, 74 define the shape of the first conductive portion 70. Preferably, the inwardly facing edge 72 is curved over a substantial portion of its length. The outwardly facing edge 74, on the other hand, includes two generally linear portions which are generally orthogonal to each other. The intersections of the inwardly and outwardly facing edges 72, 74 form ends with apexes. In this preferred embodiment, the second conductive portion 70 is operatively coupled to the first conductive portion 50 via conducting element 80.

As mentioned previously, the first and second conductive portions 50, 70 are operatively connected to each other by conducting element 80. As can been seen, the conducting element 80 is positioned on the opposite side from the major surface and preferably comprises a 22 gauge copper wire, but may of course comprise a variety of suitable conductors as is known and used in the art. Of course, suitable alternate conducting element 80 may take other forms; such as, deposited conductive trace material and the like which takes the form of a suitably sized trace on the dielectric substrate 32 (See, for example, FIG. 5, numeral 104).

Figure 5:
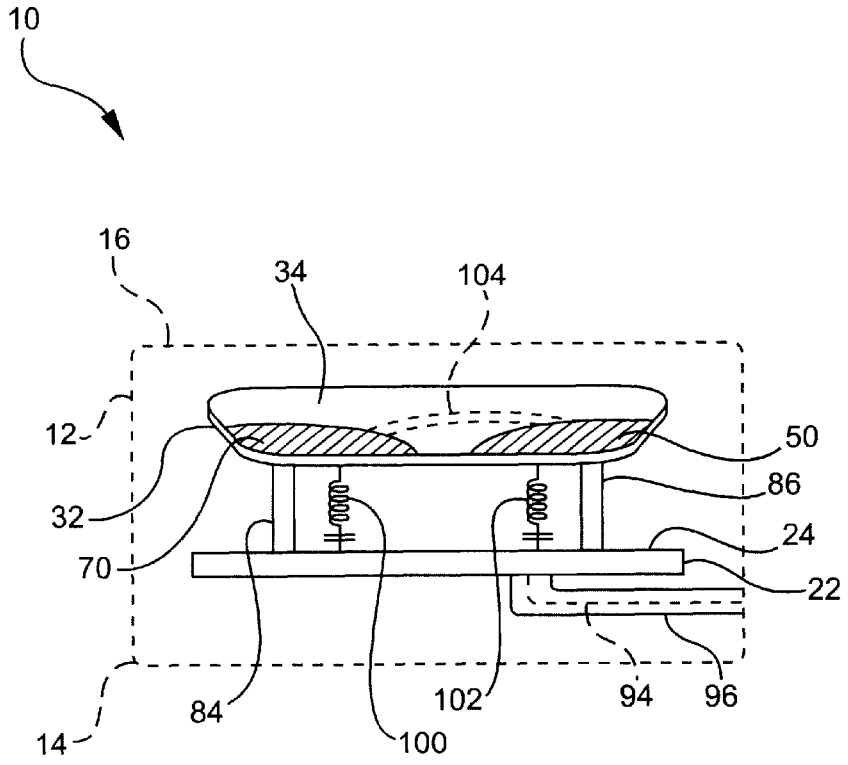
FIG. 5 is an end view of an alternative embodiment of the antenna assembly according to the present invention taken from the top of a wireless communication device, with the wireless communication device depicted in phantom; and, FIG. 6 is a side view of the antenna assembly of FIG. 5, with the wireless communication device depicted in phantom.
Figure 6:
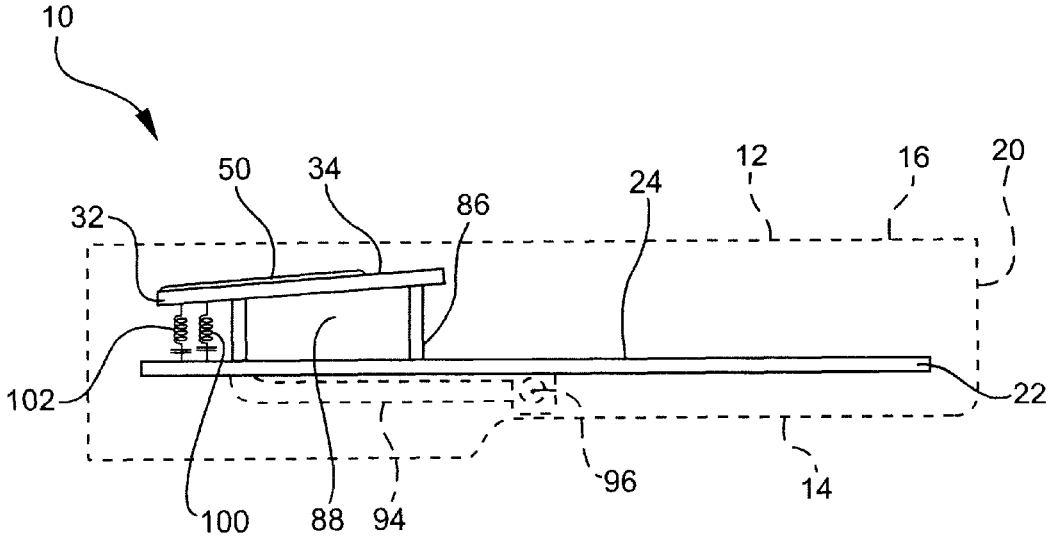

In a second preferred embodiment, depicted in FIGS. 5 and 6, the singular conductor 90 which operatively connects the resonator 40 to the ground plane 24 through the first conductive portion 50 (See, FIGS. 1 and 3) has been replaced by a first ground circuit connector 100 and a second ground circuit connector 102. The first and second ground circuit connectors 100, 102 may each comprise an inductive capacitive trap (LC) suitable designed and implemented to effectively tune the response of the antenna assembly 30 to a desired range of frequency response. With the ground circuit connectors 100, 102 a wider range of operation is possible. Although only two ground circuit connectors are depicted, it is understood that additional ground circuit connectors may be used, if desired.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept. While for simplicity and clarity a dual band antenna embodiment is taught, enabled, and fully described in detail herein, the invention also encompasses a large variety of frequency bands by adding additional conductive portions and connectors as will be readily apparent to those of skill in the art upon review and reflection of the invention described and claimed herein.

What is claimed:

1. An antenna assembly for use in a wireless communication device having a ground plane and an input/output signal port, said antenna assembly comprising:

a dielectric substrate provided a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and at least one support element inteposed between the resonator element and the ground plane.

2. An antenna assembly for use in a wireless communication device having a ground plane and an input/output signal port, said antenna assembly comprising:

a dielectric substrate provided a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and wherein the elongated conductive element is a wire conductor.

3. The antenna assembly of claim 2, wherein the wire conductor is curved over a substantial portion of its length.

4. An antenna assembly for use in a wireless communication device having a ground plane and an input/output signal port, said antenna assembly comprising:

a dielectric substrate provided a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and wherein the first conductive portion has an inwardly facing edge tat is curved.

5. The antenna assembly of claim 4, wherein the second conductive portion has an inwardly facing edge that is curved.

6. The antenna assembly of claim 4, wherein the inwardly facing edges of the first and second conductive portions are convex.

7. An antenna assembly for use in a wireless communication device having a ground plane and an input/output signal port, said antenna assembly comprising:

a generally planar dielectric substrate supported a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and at least one support element interposed between the resonator element and the ground plane.

8. An antenna assembly for use in a wireless communication device having a ground plane and an input/output signal port, said antenna assembly comprising:

a generally planar dielectric substrate supported a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and wherein the elongated conductive element is a wire conductor.

9. The antenna assembly of claim 8, wherein the wire conductor is curved over a substantial portion of its length.

10. An antenna assembly for use in a wireless communication device having a ground plane and an input/output signal port, said antenna assembly comprising:

a generally planar dielectric substrate supported a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and wherein the first conductive portion has an inwardly facing edge that is curved.

11. The antenna assembly of claim 10, wherein the second conductive portion has an inwardly facing edge that is curved.

12. The antenna assembly of claim 11, wherein the inwardly facing edges of the first and second conductive portions are convex.

13. An antenna assembly for use in a wireless communication device having a ground plane and an input/output signal port, said antenna assembly comprising:

a generally planar dielectric substrate supported a predetermined distance away from the ground plane;

a resonator element provided upon the dielectric substrate, said resonator element having a first conductive portion and a second conductive portion, with the first conductive portion being coupled to the ground plane at a first location and being coupled to the signal port at a second location, and with the second conductive portion separated from and electrically coupled to the first conductive portion via an elongated conductive element, said elongated conductive element having a length which is substantially greater than a width; and wherein the conducting element is adjacent a side of the dielectric substrate which is opposite to the first and second conductive portions.

* * * * *